US005895308A

United States Patent [19]

Spector

[11] Patent Number: 5,895,308

[45] Date of Patent: Apr. 20, 1999

[54] SOUND-PRODUCING SOFT TOY MISSILE

[76] Inventor: Donald Spector, 380 Mountain Rd., Union City, N.J. 07080

[21] Appl. No.: 09/046,842

[22] Filed: Mar. 24, 1998

[51] Int. Cl.[6] ..... A63H 5/00

[52] U.S. Cl. ..... 446/397; 446/183; 446/184; 446/297; 473/596

[58] Field of Search ..... 446/397, 399, 446/369, 184, 385; 473/571, 596, 597

[56] References Cited

U.S. PATENT DOCUMENTS

| | | | |
|---|---|---|---|
| 2,997,810 | 3/1961 | Bellas | 446/369 |
| 3,977,121 | 8/1976 | Goldfarb | 446/369 |
| 4,834,382 | 5/1989 | Spector | 273/65 |
| 5,066,259 | 11/1991 | Acker | 446/385 |
| 5,288,261 | 2/1994 | Spector | 446/267 |
| 5,544,894 | 8/1996 | Howard | 273/414 |
| 5,769,682 | 9/1996 | DiResta | 473/571 |
| 5,813,896 | 4/1997 | Spector | 446/221 |

*Primary Examiner*—Robert A. Hafer
*Assistant Examiner*—Bena B. Miller
*Attorney, Agent, or Firm*—Michael Ebert

[57] ABSTRACT

A soft toy missile which when let fly by a player and then caught by a catcher, produces upon impact, sounds appropriate to the nature of the missile. When in the configuration of a humanoid figure, the missile includes a body defined by a fabric casing stuffed with a soft compressible filler, the face of the casing having printed thereon the head and torso of the figure. Embedded in the stuffing of the body is a sound-producing unit powered by a battery through an impact-sensitive switch whereby when the missile is caught. The switch turns the unit on to generate sounds that celebrate the catch. Hinged to the body of the figure and extending therefrom are arm and leg appendages, each formed by a fabric sock stuffed with soft compressible material. When the player grasps one of these appendages and whirls the missile to let it fly, the body of the figure then rotates in the course of flight, causing the appendages to stretch out from the body to stabilize the flight. Dispersed throughout the filler are plastic beads which impart to the body of the missile the feel of a bean bag.

7 Claims, 1 Drawing Sheet

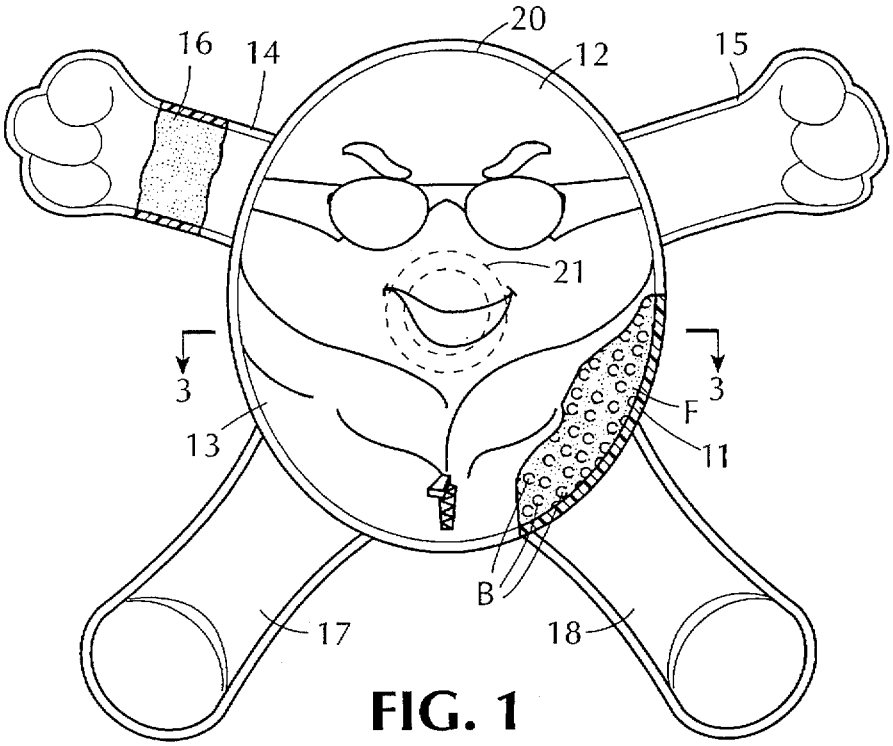
FIG. 1
FIG. 2
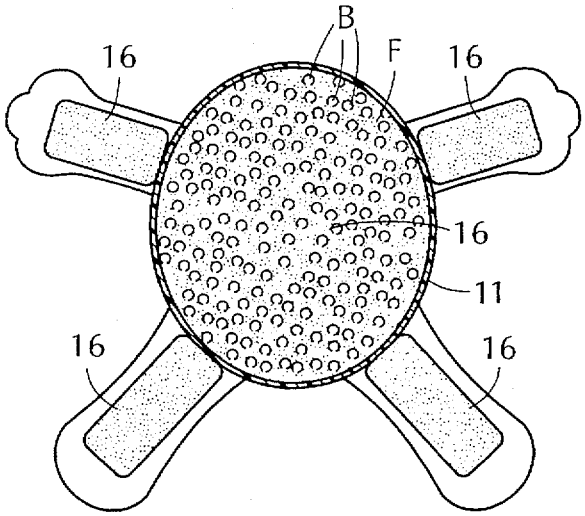
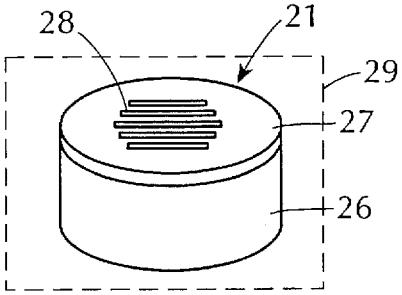
FIG. 3
FIG. 5
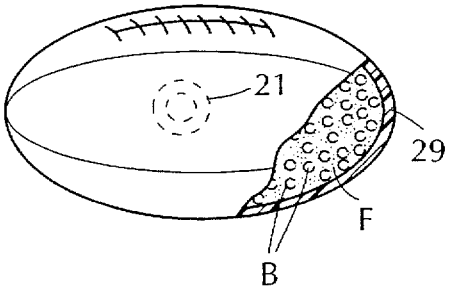
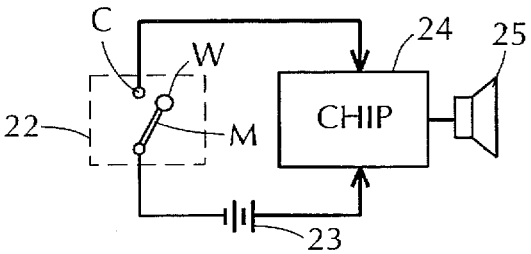
FIG. 4

SOUND-PRODUCING SOFT TOY MISSILE

BACKGROUND OF INVENTION

1. Field of Invention

This invention relates generally to soft toy missiles which are let fly by a player and are caught by a catcher, and more particularly to a missile of this type having the configuration of a humanoid figure, the missile, when caught, generating sounds which are appropriate to the figure.

2. Status of Prior Art

My prior U.S. Pat. No. 5,288,261 (Spector) discloses a figurative toy missile in animal-like or humanoid form defined by a head and a torso having appendages extending therefrom. The missile structure is such that when the missile is thrown by a player, it will spin or execute other excursions in flight, depending on how the appendages are grasped by the player. The torso is formed by an outer fabric casing enclosing a rubber balloon inflated with water, whereby the torso functions as a weighted ball.

Disclosed in my prior U.S. Pat. No. 5,649,875 is a toy missile resembling a humanoid figure, the missile including a plastic film casing confining an inflated balloon which causes the casing to assume a ball-like form. Printed on the front face of the casing is the head and torso of the figure. Hinged to an upper zone of the casing and extending therefrom is a first pair of plastic film pockets in each of which is entrapped a compressible filler to define the arm and hand appendages of the figure. Hinged to a lower zone of the casing and extending therefrom is a second pair of plastic film pockets in each of which is entrapped a compressible filler to define the leg and feet appendages of the figure. When a player grasps one of the appendages and then whirls the missile and lets it fly, the ball then rotates in the course of flight, causing the appendages to stretch out from the ball to stabilize the flight pattern.

An advantage of toy missiles of the type disclosed in my prior patents is that they are soft and compressible; hence should the missile in the course of flight strike a child, it will inflict no injury even if it hits the head of the child. This safety factor is lacking in flying toy missiles made of rigid plastic materials, such as "Frisbee" flying discs.

In the toy missiles disclosed in my prior patents, in order to create the body of the humanoid figure, one must inflate a balloon within a fabric or plastic-film casing. One drawback of this arrangement is that when the balloon is inflated, it must then be sealed by knotting the neck of the balloon. An inflated balloon, so sealed, tends to leak; hence a few hours or days after the balloon is inflated, it becomes partially deflated, thereby impairing its flying characteristics.

A toy missile whose body is formed by an air-inflated balloon is relatively light. Hence when playing outdoors, the missile is easily deflected in flight by wind gusts so that it cannot be directed by the player toward a catcher. And if the balloon is filled with water, it is so heavy that when the missile is caught, its impact with the hands of the catcher may be painful.

SUMMARY OF INVENTION

In view of the foregoing, the main object of this invention is to provide a soft toy missile formed by a stuffed fabric casing having good aerodynamic characteristics whereby the missile may be directed by a player toward a catcher.

More particularly, an object of this invention is to provide a toy missile of the above type having the configuration of a humanoid figure whose arm and leg appendages act to stabilize the flight of the missile.

Also an object of this invention is to provide a soft missile which when let fly by a player and then caught by a catcher, generates upon impact, reproduced sounds which are appropriate to the nature of the missile.

Among the significant features of a toy missile in accordance with the invention are the following:

A. A sound-producing unit embedded in the missile is only activated when the missile is caught, the resultant sounds serving to celebrate the catch.

B. The sound-producing unit embedded in the missile is impervious to water, making it possible to play with the missile in a wet environment.

C. The missile is capable of withstanding rough handling, yet is innocuous and incapable of inflicting injury.

D. The body of the missile has the feel and throwing characteristics of a bean bag.

Briefly stated, these objects are attained by a soft toy missile which when let fly by a player and then caught by a catcher, produces upon impact, sounds appropriate to the nature of the missile. The missile, when in the configuration of a humanoid figure, includes a body defined by a fabric casing stuffed with a soft compressible filler, the face of the casing having printed thereon the head and torso of the figure.

Embedded in the body is a sound-producing unit powered by a battery through an impact-sensitive switch whereby when the missile is caught, the switch turns the unit on to generate sounds that celebrate the catch. Hinged to the body of the figure and extending therefrom are arm and leg appendages, each formed by a fabric sock stuffed with soft compressible material. When the player grasps one of these appendages and whirls the missile to let it fly, the body of the figure then rotates in the course of flight, causing the appendages to stretch out from the body to stabilize the flight.

Dispersed throughout the filler are plastic beads which impart to the body of the missile the feel of a bean bag.

BRIEF DESCRIPTION OF DRAWING

For a better understanding of the invention, as well as further features thereof, reference is made to the detailed description thereof to be read in connection with the annexed drawings wherein:

FIG. 1 is a perspective front view of a humanoid toy missile in accordance with the invention;

FIG. 2 is a section taken through the missile;

FIG. 3 is a separate showing of the sound-producing unit included in the missile;

FIG. 4 is a schematic diagram of this unit; and

FIG. 5 shows a toy missile in accordance with the invention which has the configuration of a football.

DESCRIPTION OF INVENTION

As shown in FIGS. 1 and 2, a toy missile in accordance with the invention in the embodiment illustrated therein resembles a humanoid figure. By a humanoid figure is meant any figure which like a human being has arm and leg appendages, but not necessarily the face of a human being. Thus the humanoid figure may be a fanciful creature from outer space, or a figure resembling an ape.

The figure includes a body 10 defined by a non-stretchable fabric casing 11 having an oval shape, casing 11 being stuffed with a soft, compressible filler to impart a three-dimensional form thereto.

The filler is preferably constituted by fiberfill. Fiberfill consists of light weight, synthetic plastic fibers of the type commonly used as a filling in pillows or comforters. Hence the soft body of the figure has the feel of a pillow. Dispersed throughout the fiberfill are beads B formed of a synthetic plastic, such as polyethylene which is non-absorbent and therefore impermeable to liquids.

Beads B dispersed throughout the fiberfill not only contribute weight to body 10 of the figure, but also impart to the body the feel of a bean bag. A bean bag is a small bag filled with dried beans which is used for throwing in games. The combined tactile effect of the fiberfill and the beads is a cross between a bean bag and a pillow.

Fabric casing 11 is preferably fabricated of tightly-woven synthetic fibers, such as nylon, to produce a high-strength and durable casing capable of withstanding rough handling by those who play with the missile.

Printed, screened or otherwise impressed on the front face of casing 11 is a multi-colored drawing of a selected humanoid figure, except for its appendages. What mainly appears on the front face of casing 11 in the upper zone thereof is the head 12 of the humanoid figure, a torso 13 of this figure appearing in the lower zone of the casing.

Articulated from the upper zone of casing 11 and extending from opposite sides thereof at the shoulders of the figure is a first pair of appendages 14 and 15 which define the arms and hands of the figure. Appendages 14 and 15 are each created by a fabric sock preferably formed of the same fabric as the casing. Entrapped within the sock whose closed upper end is sewn to casing 11 to hinge the sock thereto is a soft compressible padding or filler, such as a flexible foam plastic pad 16 of urethane material. The padding imparts a three dimensional life-like form to the appendages.

Hinged to the lower zone of casing 11 and extending outwardly form the crotch region of torso 13 is a second pair of appendages 17 and 18. These define the legs and feet of the humanoid figure and are formed in the same manner as the first pair of appendages by means of fabric socks having a padding entrapped therein.

Embedded within the filler contained within fabric casing 11 forming the body of the figure is a self-sufficient sound-producing unit 21. Unit 21, as shown separately in FIGS. 3 and 4, includes an impact-sensitive switch 22 which when closed connects a battery 23 to an integrated circuit chip 24 in which sounds to be reproduced are digitally stored on a ROM or other memory device.

When switch 22 closes to activate chip 24, the sounds digitally recorded therein are downloaded and converted into an analog signal. This signal is amplified and reproduced in a miniature loud speaker 25.

Switch 22 includes a flexible metal strip acting as a movable contact M, the strip when flexed engaging a fixed contact C to close the switch. A weight W secured to the free end of contact M renders the switch sensitive to acceleration forces.

Hence when the missile is caught by a catcher, the resultant impact causes movable contact M to flex and engage fixed contact C, thereby closing the switch to activate the unit to reproduce the sounds stored therein.

Other forms of impact-sensitive switches may be used, such as a switch that includes a pool of mercury which normally engages only one contact of the switch, but when subjected to an impact force, then bridges both contacts of the switch to close the circuit.

The sounds produced by the unit are preferably related to the humanoid figure represented by the missile. Thus if the figure is that of a gnome having a high-pitched voice, then when this gnome is caught by a catcher, the unit upon impact will reproduce of the high-pitched voice of the gnome to say "Good Catch Pal" or some other expression appropriate to the figure. But in practice the sounds may be musical rather than verbal. Thus if the figure if that of Santa Claus, then upon impact, the sounds can say "Merry X-mas" or the tune of "Jingle Bells". Thus the sounds are such as to effectively celebrate the successful catch.

In order to launch a missile, a player grasps it by one of the appendages and then whirls the missile and releases it to let it fly. Because the missile has been whirled, the oval body of the missile is caused to rotate in the course of flight. The resultant centrifugal forces cause the soft appendages extending from the body to stretch out and thereby stabilize the flight pattern.

The missile is innocuous, for should it strike a child or an object, it will not injure the child or damage the object, for the soft appendages of the missile cushion the impact.

Unit 21 and all components thereof including the batteries are contained in a wafer-shaped plastic housing whose top wall 27, as shown, is provided with slots 28 to vent the sounds emanating from speaker 25 placed behind these slots.

Unit 21 is enveloped by a pouch 29 formed of Mylar (polyester) film or any other thin plastic film impervious to liquids. The pouch serves to waterproof the unit without however blocking the sounds emanating from the unit, for the film acts as a diaphragm.

The reason it is desirable to waterproof the unit is that in playing with the missile, it may fall into a water-filled pool or be exposed to rain. Except for unit 21, the missile is fabricated entirely of synthetic plastic materials which are not isolated from water, such as the fiberfill stuffing. But these synthetic plastic materials do not absorb water, and when wet, quickly dry out.

The toy missile need not be in a humanoid or other form having appendages. Thus it may take the form of a circular space ship which is defined by a circular fabric casing having a compressible stuffing therein; in which case the missile is whirled into space like a Frisbee disc.

Or the missile, as shown in FIG. 5, may be in the form of a soft football that can be thrown as such, rather than whirled. This football includes an outer fabric casing 26 which has the shape of a football stuffed with a filler constituted by fiberfill F having plastic beads B dispersed therein. This football, because of the beads which feel like beans, is a hybrid of a stuffed football and a bean bag and provides, when being handled, a novel tactile sensation.

Embedded in this filler of the football is a sound-producing unit 21 which when the football is caught by a catcher, produces a sound appropriate to this catch, such as "Touch Down." In all embodiments of this soft missile, the sound producing unit should be adjacent the fabric casing so that sounds emanating from the unit are not absorbed by the filling surrounding the unit.

While there has been shown and described preferred embodiments of a sound-producing soft toy missile, it will be appreciated that many changes and modifications may be made therein without, however, departing from the essential spirit thereof.

I claim:

1. A soft toy missile resembling an object which is a humanoid figure having a predetermined three-dimensional shape, said missile comprising:

A. a fabric outer casing having a two-dimensional form resembling the shape of the object; and B. a compressible filler stuffing the casing to impart thereto the three-dimensional shape of the object, said filler having dispersed therein beads which cause the missile to feel like a bean bag, the stuffed casing constituting the body of the humanoid figure whose legs and arms are formed by appendages hinged to the casing, each appendage being defined by a fabric sock in which is entrapped a compressible pad.

2. A missile as set forth in claim 1, in which the fabric of the casing, the filler and the beads are all formed of synthetic plastic material.

3. A missile as set forth in claim 1, in which the object is a football.

4. A missile as set forth in claim 1, in which embedded in the filler is a sound-producing unit which reproduces sounds stored therein only upon impact of the missile.

5. A missile as set forth in claim 4, in which the unit is enveloped in a liquid-impermeable pouch that is permeable to sounds emanating from the unit.

6. A missile as set forth in claim 4, in which the unit includes an impact-actuated switch connecting a power source to the unit to activate the unit when the switch is closed.

7. A missile as set forth in claim 6, in which the unit includes an integrated-circuit chip in which is digitally stored the sounds which when the switch is closed is downloaded and converted into an analog signal which is reproduced.

* * * * *